US007070443B2

(12) United States Patent
Tashiro et al.

(10) Patent No.: US 7,070,443 B2
(45) Date of Patent: Jul. 4, 2006

(54) STRUCTURE FOR CONNECTING A COMBINATION LAMP

(75) Inventors: Harunori Tashiro, Shizuoka (JP); Masaru Fukuda, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 26 days.

(21) Appl. No.: 10/274,404

(22) Filed: Oct. 21, 2002

(65) Prior Publication Data

US 2003/0077933 A1 Apr. 24, 2003

(30) Foreign Application Priority Data

Oct. 22, 2001 (JP) ..... P2001-323603

(51) Int. Cl.
*H01R 4/26* (2006.01)

(52) U.S. Cl. ..... 439/419; 439/404

(58) Field of Classification Search ..... 439/404, 439/405, 419 I; 362/249
See application file for complete search history.

(56) References Cited

U.S. PATENT DOCUMENTS 4,777,573 A * 10/1988 Liao ..... 362/249
5,109,324 A * 4/1992 Ahroni ..... 362/249
5,634,812 A * 6/1997 Chen ..... 439/419
5,672,000 A * 9/1997 Lin ..... 362/249
6,022,241 A * 2/2000 Lin ..... 439/419
6,079,848 A * 6/2000 Ahroni ..... 362/249
6,250,970 B1 * 6/2001 Key et al. ..... 439/699.2
6,328,593 B1 * 12/2001 Chang et al. ..... 439/419

FOREIGN PATENT DOCUMENTS

| | | |
|---|---|---|
| DE | 27 17 769 A1 | 4/1977 |
| DE | 41 27 899 A1 | 8/1991 |
| DE | 196 04 222 A1 | 2/1996 |
| DE | 196 15 600 A1 | 4/1996 |
| DE | 200 17 947 U1 | 10/2000 |
| JP | 10-31906 | 2/1998 |

* cited by examiner

*Primary Examiner*—Thanh-Tam Le
(74) *Attorney, Agent, or Firm*—Sughrue Mion, PLLC

(57) ABSTRACT

An insulation displacement connector (40) selectively effects insulation displacement of required conductive paths of a flat cable (30) in correspondence with the function of a bulb socket connector (20). Further, the other unnecessary conductive paths are passed through without being subjected to insulation displacement connection. In addition, as the insulation displacement connector (40) and a socket housing with a bulb (21) fitted thereto are engaged, insulation displacement terminals and bulb conductor portions of the bulb (21) are electrically connected directly.

4 Claims, 12 Drawing Sheets

STRUCTURE FOR CONNECTING A COMBINATION LAMP

BACKGROUND OF THE INVENTION

The present invention relates to a structure for connecting a combination lamp for connecting the combination lamp to a wire harness, and more particularly to a connecting structure which is low cost, simple, and reliable.

Conventionally, as shown in FIG. 11, JP-A-10-31906 discloses a lighting apparatus for a vehicle 50 in which a bulb socket 51 integrally having a connector housing constitutes a power feeding socket by connecting a vehicle body-side cable 60 thereto, and in which the bulb socket 51 is connected in a distributive manner to other bulb sockets 54 via splicers 52 and cables (single-core cables) 53. Each of the bulb sockets 51 and 54 holds a bulb 57 in a socket attaching hole 56 provided in a rear surface of a lighting apparatus body 55.

In the above-described lighting apparatus for a vehicle 50, the connector joining portions are concentrated at one location by using the cables 53. Namely, a wire harness-side connector 61 at a terminal of the vehicle body-side cable 60, which is a branch line jointed to a trunk line of the wire harness, is joined to the bulb socket 51 for making up the power feeding socket, and the bulb socket 51 and the other bulb sockets 54 are electrically connected via the corresponding splicers 52 and cables 53.

In addition, as shown in FIG. 12, another lighting apparatus for a vehicle 70 is known in which the distributive connection is effected by a flexible printed circuit (FPC) or FFC 76 instead of the aforementioned cables (single-core cables) 53. Namely, the FPC 76 is screwed to the rear surface of a lamp body 75. A socket connector 71 with a bulb 77 fitted thereto is fitted in a socket attaching hole 76*a*, and an insulation displacement connector 72 subjected to insulation displacement connection to a flat cable 73 is fitted to the socket connector 71 and is hence electrically connected thereto.

As shown in FIG. 13, a plurality of socket terminals 81 are accommodated in the socket connector 71. A socket housing 78 with the bulb 77 fitted thereto is fitted to this socket connector 71 from the front side of this socket connector 71.

A plurality of terminals 82 respectively having insulation displacement blades 82*a* are accommodated in the insulation displacement connector 72, and the flat cable 73 is subjected to insulation displacement connection to the insulation displacement blades 82*a* of this insulation displacement terminals 82 by the pressing force of a connector cover 79 (or by an automatic machine).

As for the electrical connection of the other bulb sockets 74, the distributive connection is effected from the insulation displacement connector 72 via the socket connector 71 and the FPC 76. Namely, the distributive connection is effected as the socket terminals 81 exposed from the socket connector 71 are brought into contact with unillustrated conductive paths which are conductive with the bulb socket 74 on the FPC 76 at the time of the fitting of the socket connector 71.

However, with the above-described conventional lighting apparatus for a vehicle 50, the structure is complex, and the number of component parts and the number of assembling steps become large. In addition, externally fitting members (winding tape, clamps, etc.) for fixing the cables 53 to the lighting apparatus body 55 are also required, so that there is the problem that the cost becomes high.

In addition, with the above-described conventional lighting apparatus for a vehicle 70, the socket terminals 81 are required in a large number, so that the number of component parts and the number of assembling steps become large. Furthermore, since the FPC 76 is used, there has been the problem that the cost becomes high.

SUMMARY OF THE INVENTION

The object of the invention is to provide a structure for connecting a combination lamp which makes it possible to establish reliable electric connection, reduce the number of component parts and the number of assembling steps by simplifying the structure, and effect a substantial reduction in cost.

In order to solve the aforesaid object, the invention is characterized by having the following arrangement.

(1) A structure for connecting a combination lamp to a wire harness comprising:

a plurality of bulb socket connectors fitted to the combination lamp;

a plurality of insulation displacement connectors mounted on the plurality of bulb socket connectors, respectively; and a flat cable including conductive paths, mounted on the plurality of insulation displacement connectors, one end thereof being connected to an electric junction box, wherein each of the plurality of insulation displacement connectors selectively effects insulation displacement connection to required one of the conductive paths according to a function of each of the plurality of bulb socket connectors, and unnecessary one of the conductive path is passed through the corresponding insulation displacement connectors without being subjected to insulation displacement connection.

(2) The structure according to (1), wherein the combination lamp is provided on either side of a rear end of a vehicle body.

(3) A connecting structure for a combination lamp comprising:

a bulb socket housing, on which a bulb is mounted, fitted to of a lamp body of the combination lamp;

a flat cable, one end thereof being connected to an electric junction box;

an insulation displacement connector including insulation displacement terminals subjected to insulation displacement connection at a predetermined position on the flat cable; and contact spaces for contact between bulb conductor portions exposed at a rear end of the bulb and the insulation displacement terminals, wherein each of the insulation displacement terminals and each of the bulb conductor portions are electrically connected directly as the insulation displacement connector is engaged with the bulb socket housing with the bulb fitted thereto.

(4) The structure according to (3), wherein the bulb socket housing is provided with a flexible arm for retaining the bulb conductor portion, and a housing of the insulation displacement connector is provided with a flexible lock arm for locking the flexible arm.

(5) The structure according to (3), wherein the housing of the insulation displacement connector is provided with a housing lock for retaining the socket housing.

(6) The structure according to (3), wherein the combination lamp is provided on either side of a rear end of a vehicle body.

DETAILED DESCRIPTION OF PREFERRED EMBODIMENTS

Figure 1:
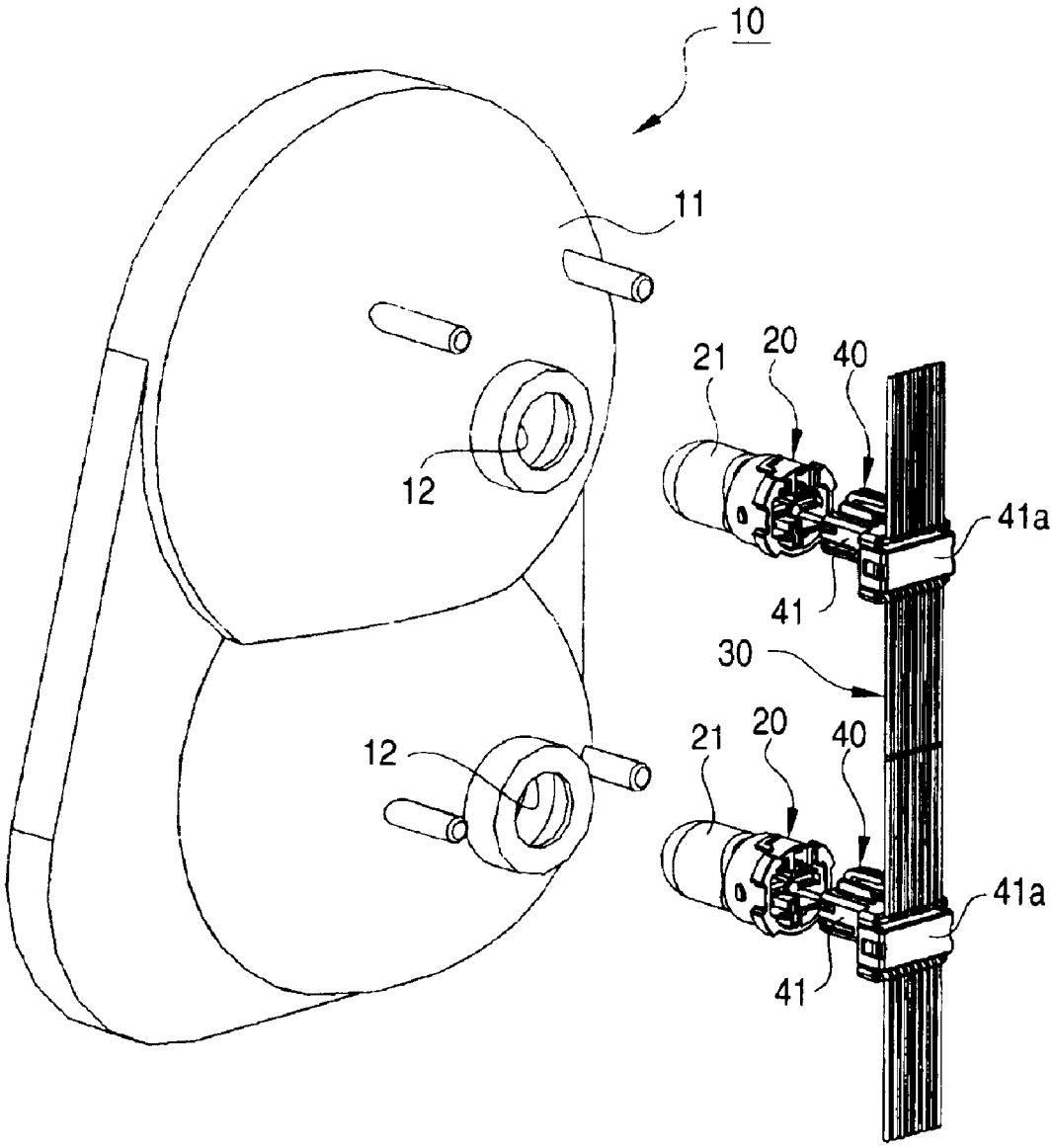
FIG. 1 is an exploded perspective view illustrating the structure for connecting a rear combination lamp in accordance with this embodiment.
Figure 2:
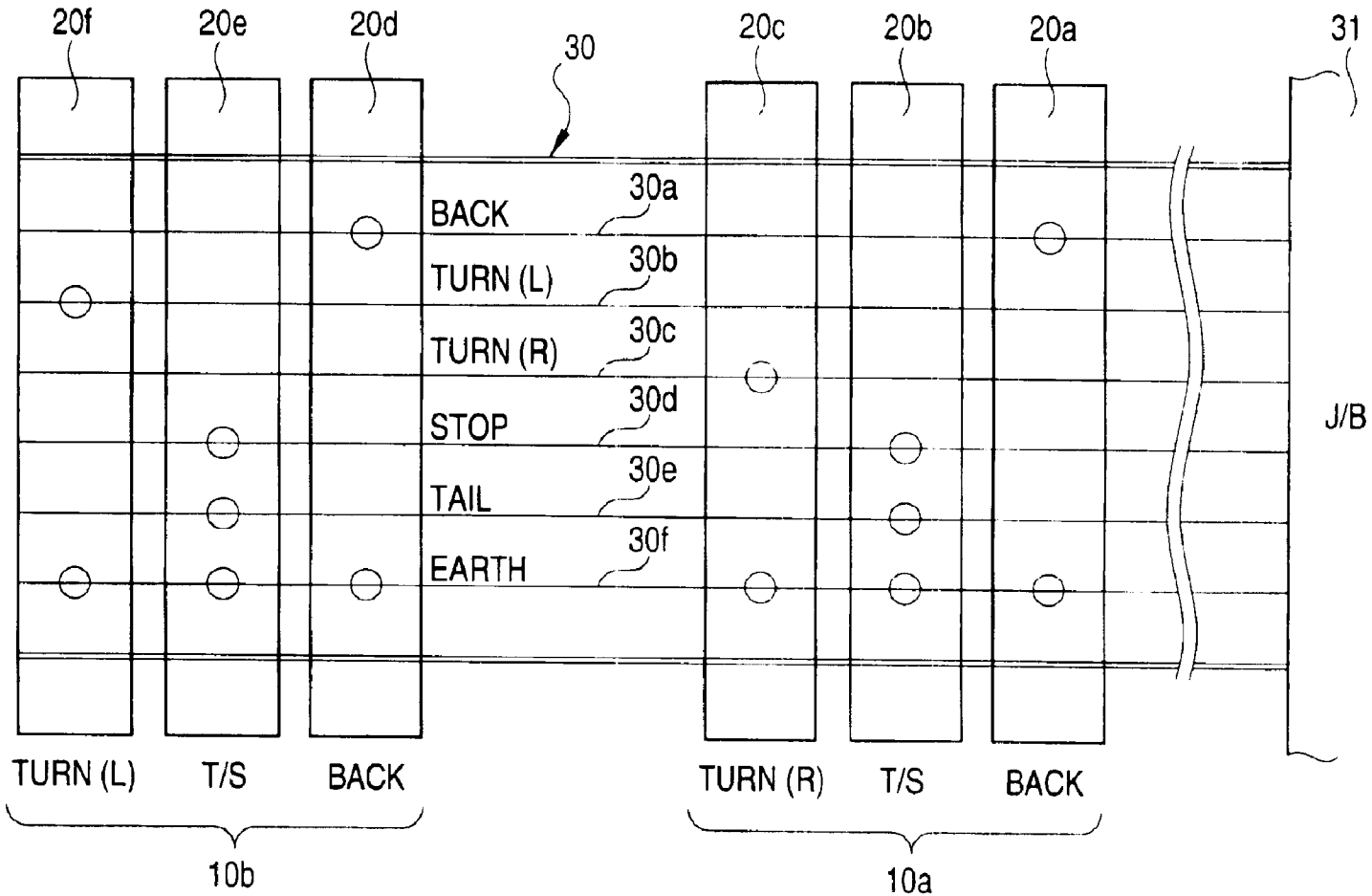
FIG. 2 is a schematic diagram illustrating the state of insulation displacement connection of a flat cable in FIG. 1.

Referring now to FIGS. 1 to 10, a description will be given of an embodiment of the structure for connecting a combination lamp. FIG. 1 is an exploded perspective view illustrating the structure for connecting a rear combination lamp in accordance with this embodiment. FIG. 2 is a schematic diagram illustrating the state of insulation displacement connection of a flat cable in FIG. 1.

Figure 3:
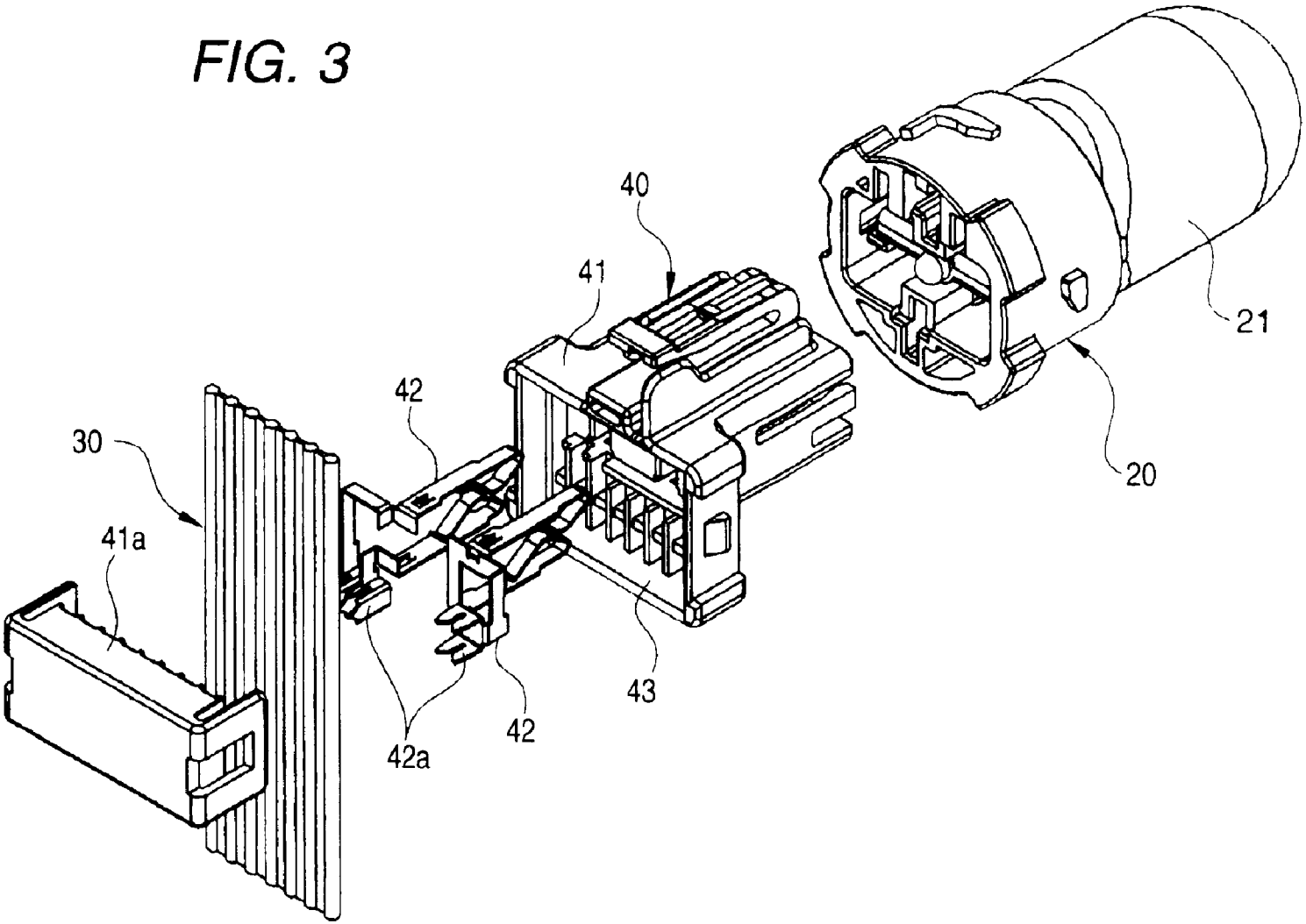
FIG. 3 is an exploded perspective view illustrating the details of a bulb socket in FIG. 1.
Figure 4:
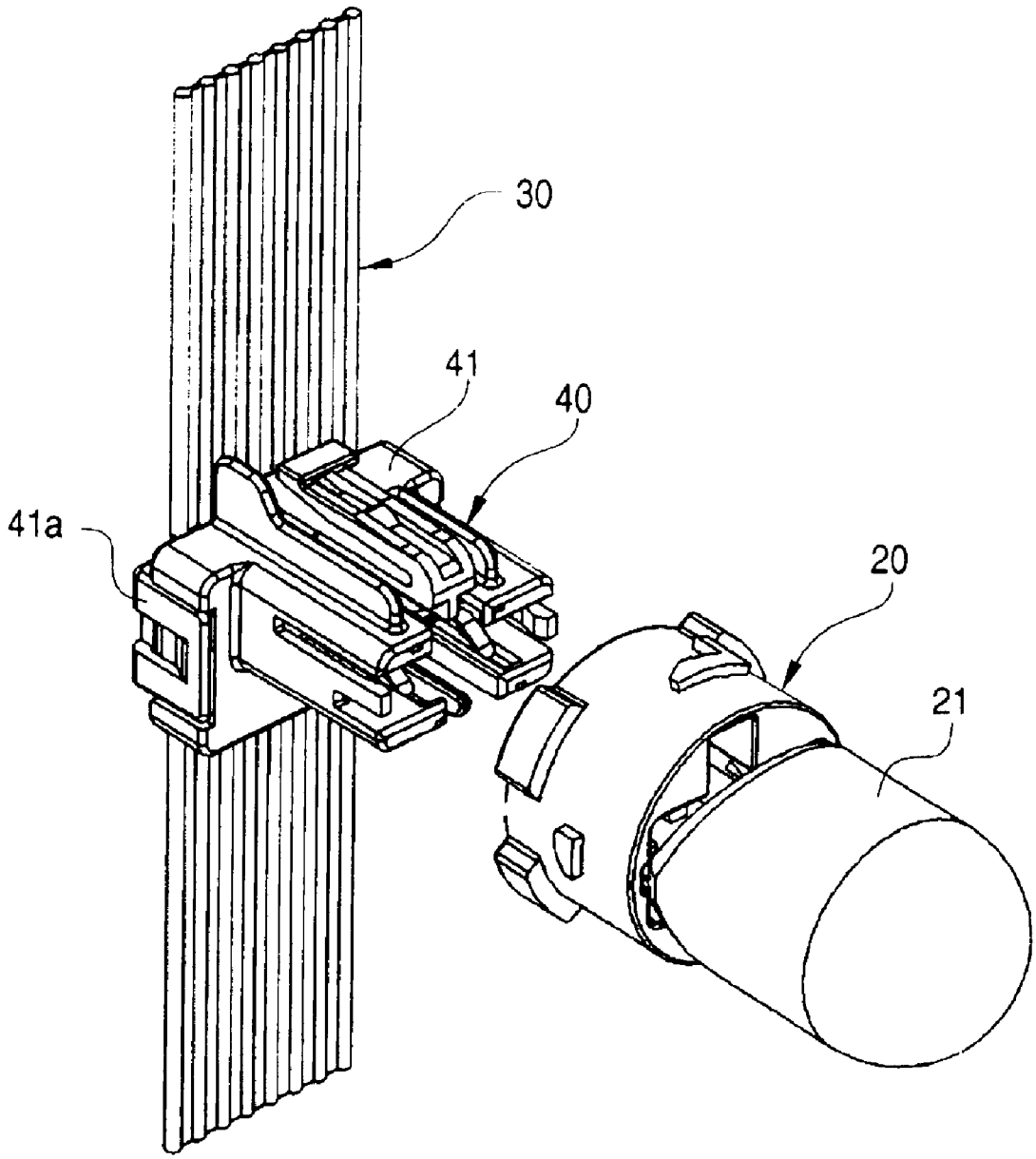
FIG. 4 is a perspective view illustrating a state in which an insulation displacement connector in FIG. 3 is fitted to the flat cable.

FIG. 3 is an exploded perspective view illustrating the details of a bulb socket in FIG. 1, and FIG. 4 is a perspective view illustrating a state in which an insulation displacement connector in FIG. 3 is fitted to the flat cable.

Figure 5:
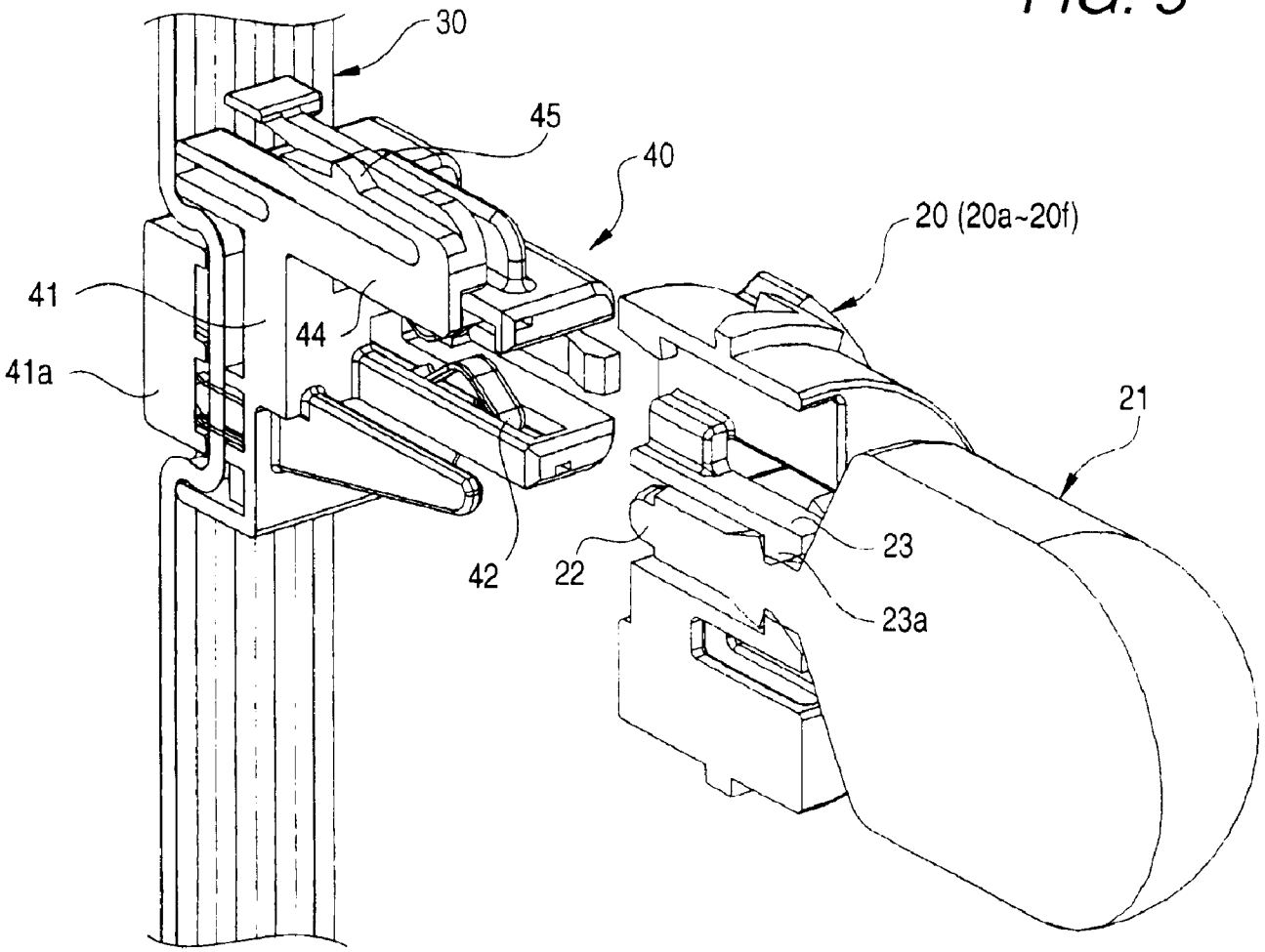
FIG. 5 is a perspective view illustrating the flat cable, the insulation displacement connector, and a socket connector in FIG. 4.
Figure 6:
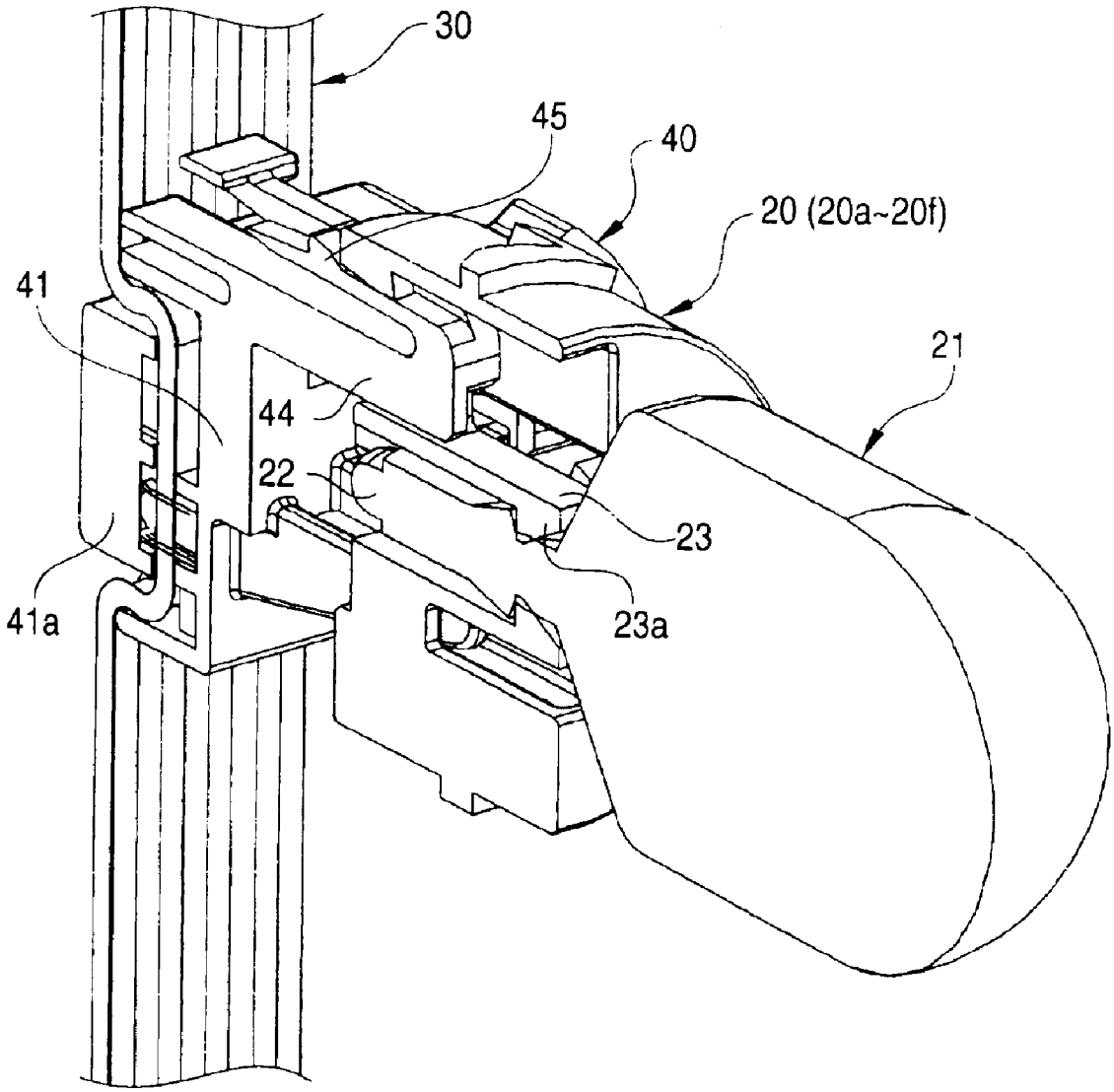
FIG. 6 is a perspective view illustrating an interim state in which the socket connector is being engaged with the insulation displacement connector.
Figure 7:
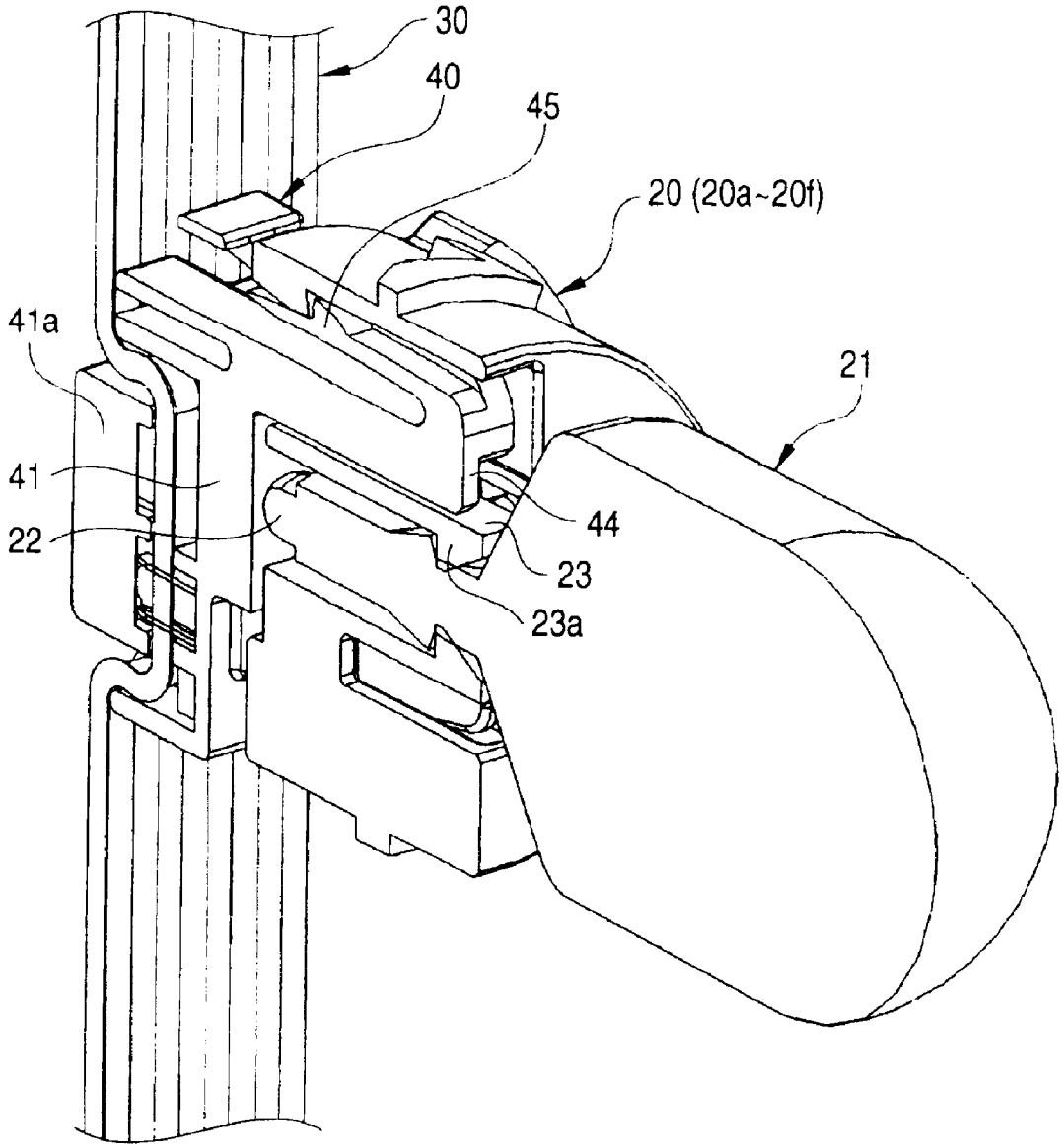
FIG. 7 is a perspective view illustrating a state in which the engagement of the socket connector with the insulation displacement connector in FIG. 6 has been completed.

FIG. 5 is a perspective view illustrating the flat cable, the insulation displacement connector, and a socket connector in FIG. 4. FIG. 6 is a perspective view illustrating an interim state in which the socket connector is being engaged with the insulation displacement connector. FIG. 7 is a perspective view illustrating a state in which the engagement of the socket connector with the insulation displacement connector in FIG. 6 has been completed.

Figure 8A:
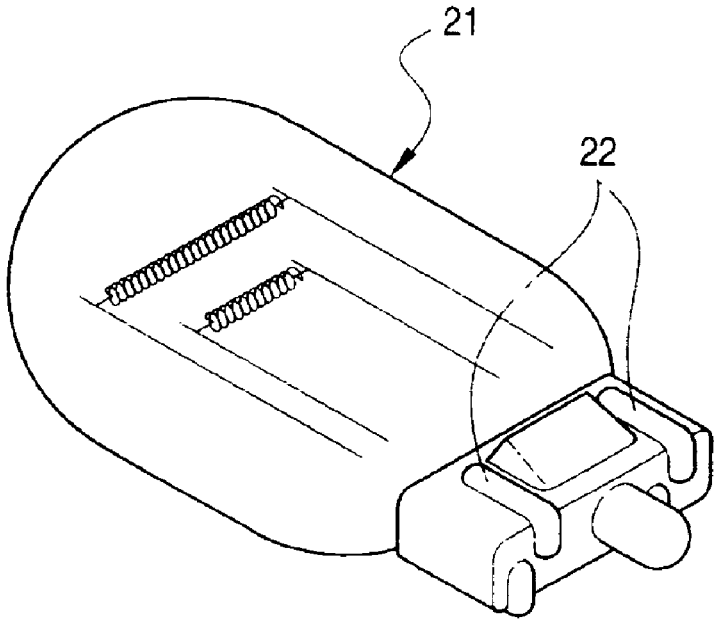
FIGS. 8A and 8B are perspective views respectively illustrating bulbs as single units.
Figure 8B:
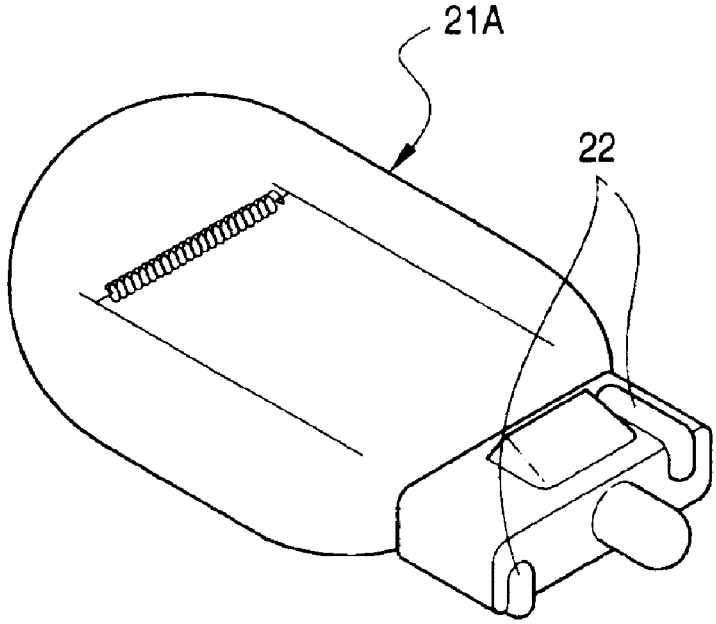
Figure 9:
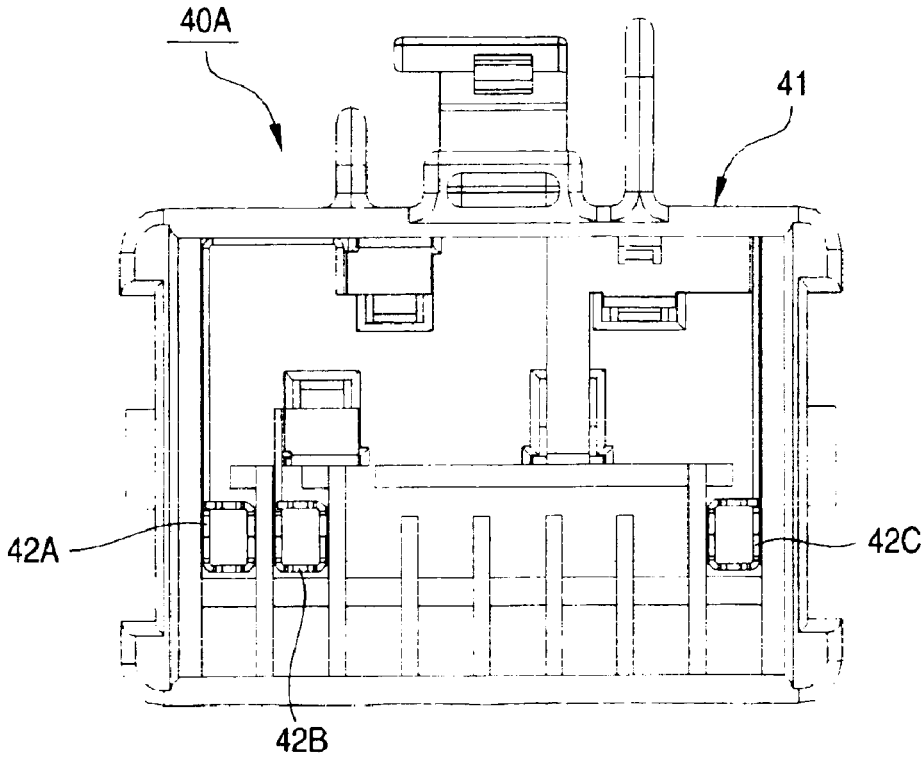
FIG. 9 is a rear view illustrating an example of the insulation displacement connector corresponding to the through insulation displacement of the flat cable.
Figure 10:
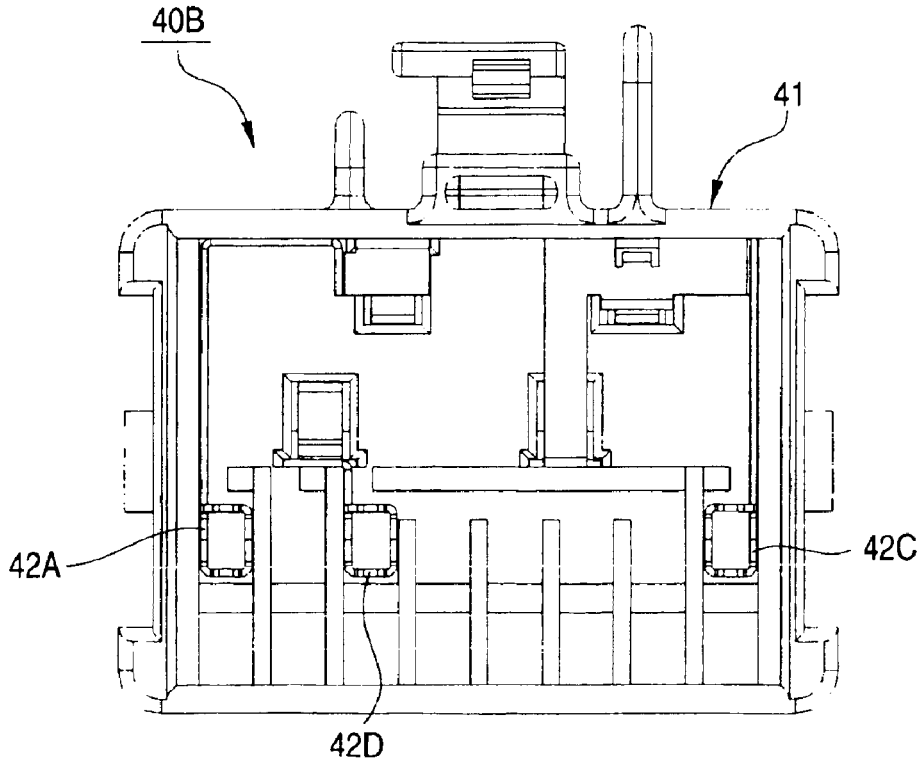
FIG. 10 is a rear view illustrating another example of the insulation displacement connector corresponding to the through insulation displacement of the flat cable.
Figure 11:
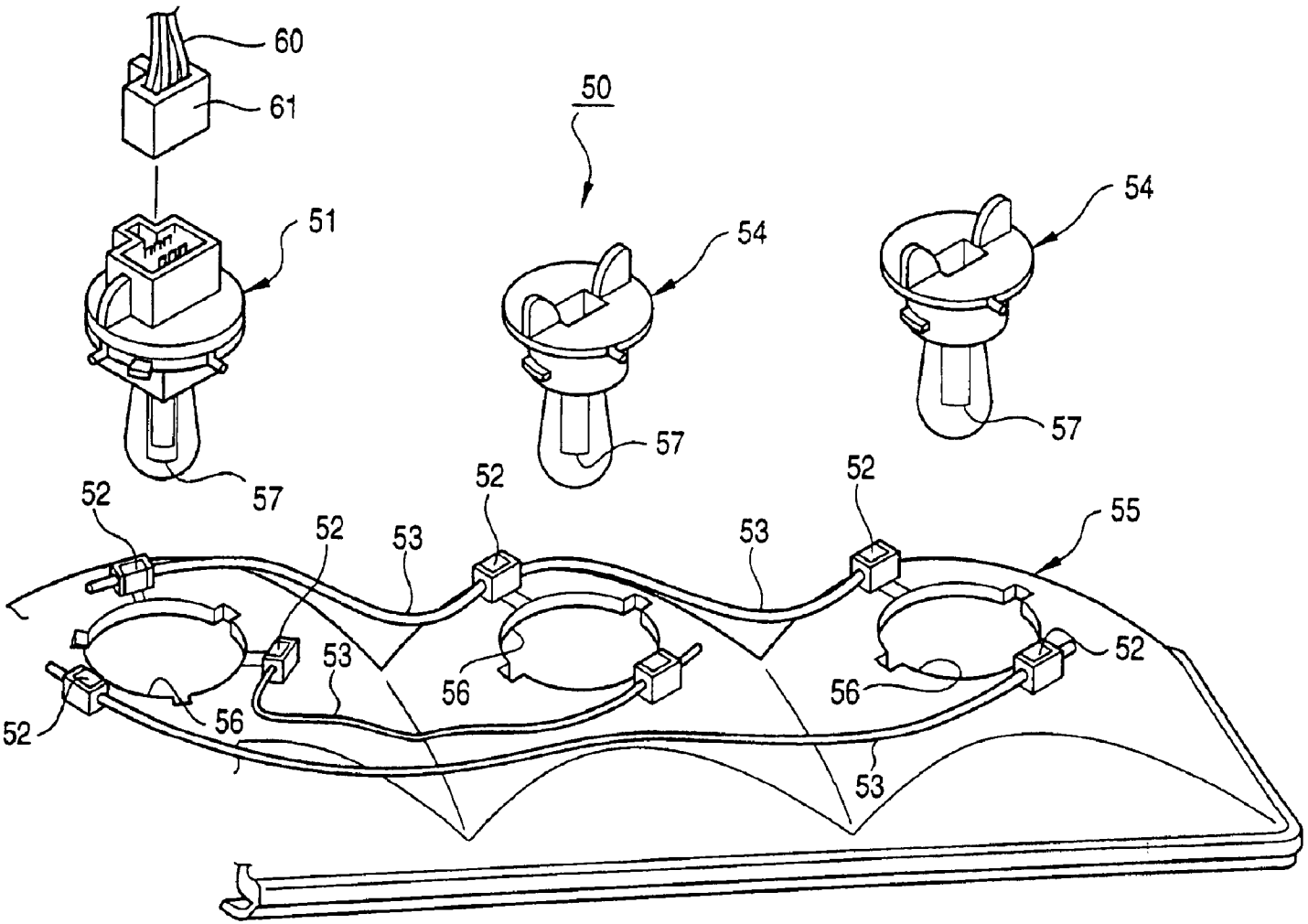
FIG. 11 is an exploded perspective view illustrating a conventional lighting apparatus for a vehicle.
Figure 12:
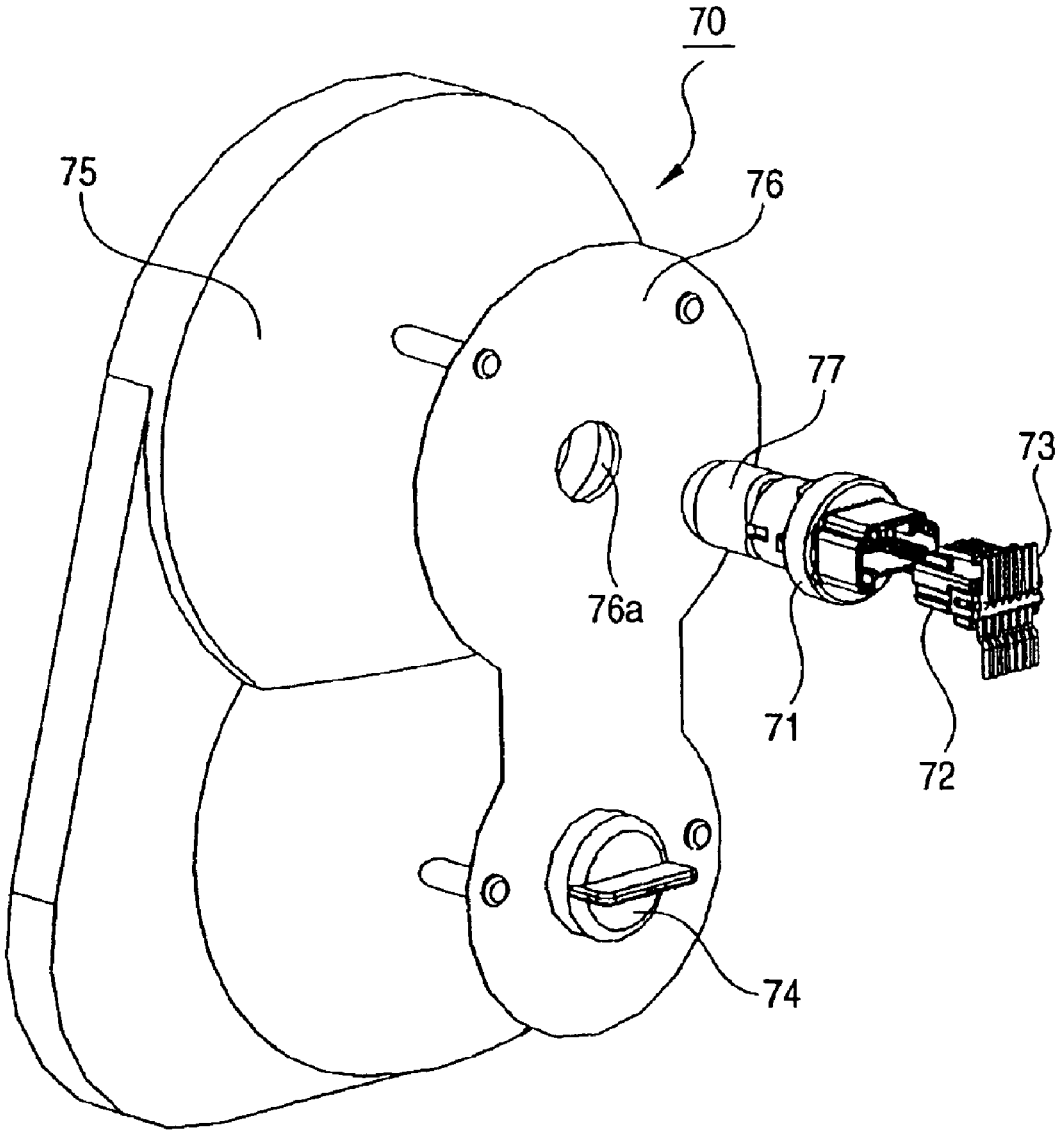
FIG. 12 is an exploded perspective view illustrating another conventional lighting apparatus for a vehicle.
Figure 13:
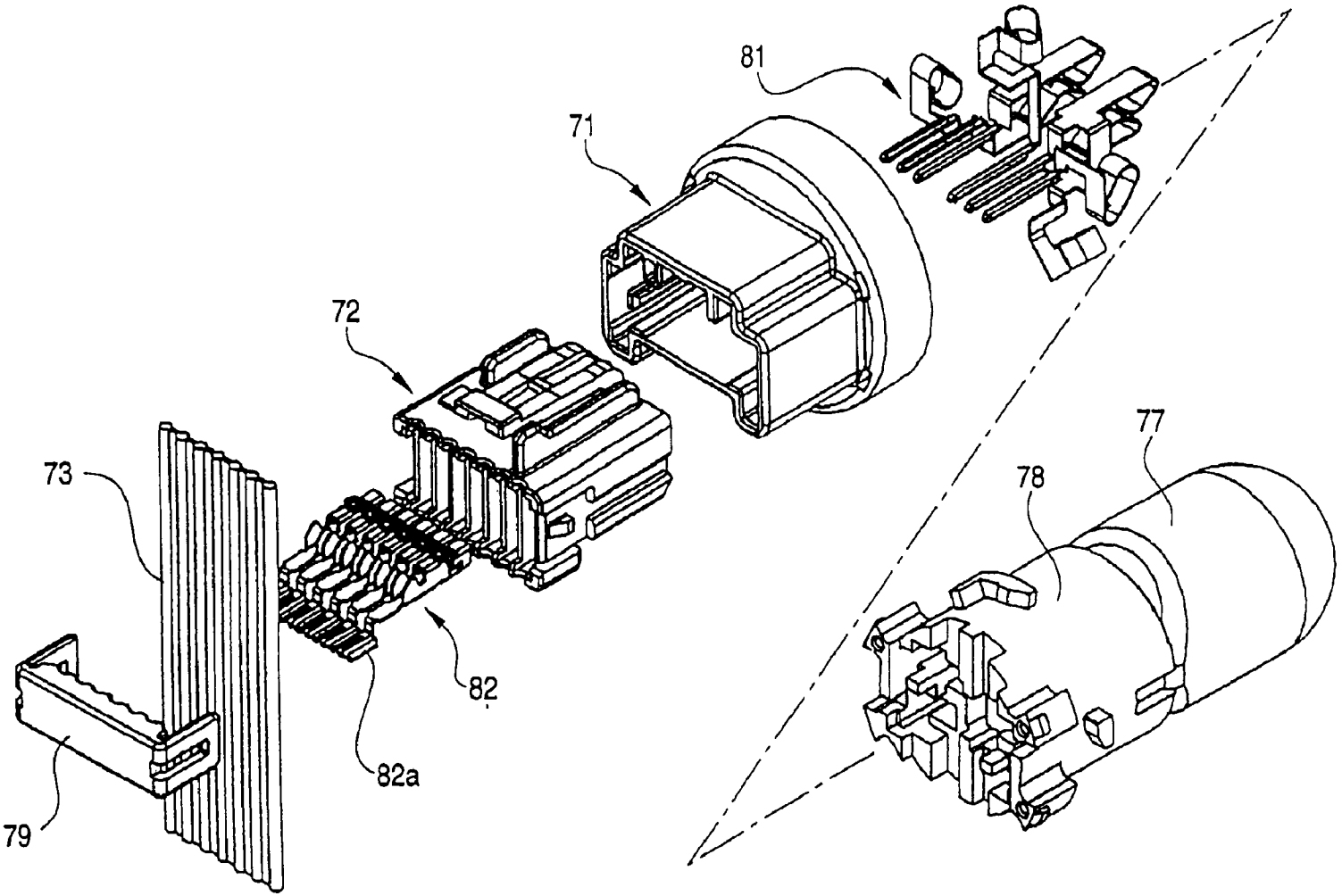
FIG. 13 is an exploded perspective view illustrating the insulation displacement connector and the socket connector in FIG. 12.

FIGS. 8A and 8B are perspective views respectively illustrating bulbs as single units. FIG. 9 is a rear view illustrating an example of the insulation displacement connector corresponding to the through insulation displacement of the flat cable, and FIG. 10 is a rear view illustrating another example of the insulation displacement connector corresponding to the through insulation displacement of the flat cable.

As shown in FIG. 1, a pair of rear combination lamps 10 in accordance with this embodiment are respectively provided on left- and right-hand sides in the transverse direction of a rear end of a vehicle body. A plurality of bulb socket connectors 20 having bulbs 21 fitted to their front ends are mounted in socket mounting holes 12 provided in a lamp body 11 of the rear combination lamp 10. An insulation displacement connector 40, in which a flat cable 30 is subjected to insulation displacement connection by a connector cover 41*a* to unillustrated insulation displacement terminals accommodated in a connector housing 41, is engaged with this bulb socket connector 20.

It should be noted that apart from the insulation displacement connection by the connector cover 41*a*, insulation displacement connection by an automatic machine is frequently adopted.

As for each insulation displacement connector 40, required conductive paths of the flat cable 30 are selectively subjected to insulation displacement connection by insulation displacement terminals 42 in correspondence with the function of each bulb socket connector 20, e.g., depending on such as whether the bulb socket connector corresponds to a TAIL & STOP (T/S) bulb or a TURN (R or L) bulb. The other unnecessary conductive paths are passed through as they are without being subjected to the insulation displacement connection by the insulation displacement terminals 42.

More specifically, a description will be given of an example in which, as shown in FIG. 2, conductive paths 30*a* to 30*f* of the flat cable 30 connected to an electric junction box (J/B) 31 are set as BACK 30*a*, TURN (L) 30*b*, TURN (R) 30*c*, STOP 30*d*, TAIL 30*e*, and EARTH 30*f* in that order from top to bottom in the drawing. It should be noted that circles "○" in the drawing indicates portions subjected to insulation displacement connection.

In the case of a rear combination lamp (R) 10*a* on the right-hand side of the vehicle body, as for a bulb socket connector 20*a* corresponding to the BACK bulb, the BACK and EARTH conductive paths 30*a* and 30*f* of the flat cable 30 are subjected to insulation displacement connection thereto. The TURN (L), TURN (R), STOP, and TAIL conductive paths 30*b*, 30*c*, 30*d*, and 30*e* are passed through.

As for a bulb socket connector 20*b* corresponding to the T/S bulb, the STOP, TAIL, and EARTH conductive paths 30*d*, 30*e*, and 30*f* of the flat cable 30 are subjected to insulation displacement connection thereto. The BACK, TURN (L), and TURN (R) conductive paths 30*a*, 30*b*, and 30*c* are passed through.

As for a bulb socket connector 20*c* corresponding to the TURN (R) bulb, the TURN (R) and EARTH conductive paths 30*c* and 30*f* of the flat cable 30 are subjected to insulation displacement connection thereto. The BACK, TURN (L), STOP, and TAIL conductive paths 30*a*, 30*b*, 30*d*, and 30*e* are passed through.

In the case of a rear combination lamp (L) 10*b* on the left-hand side of the vehicle body, as for a bulb socket connector 20*d* corresponding to the RACK bulb, the same conductive paths 30*a* and 30*f* as those of the aforementioned bulb socket connector 20*a* are subjected to insulation displacement connection thereto, and the conductive paths 30*b*, 30*c*, 30*d*, and 30*e* are passed through.

As for a bulb socket connector 20*e* corresponding to the T/S bulb, the same conductive paths 30*d*, 30*e*, and 30*f* as those of the aforementioned bulb socket connector 20*b* are subjected to insulation displacement connection thereto, and the conductive paths 30*a*, 30*b*, and 30*c* are passed through.

As for a bulb socket connector 20*f* corresponding to the TURN (L) bulb, the TURN (L) and EARTH conductive paths 30*b* and 30*f* of the flat cable 30 are subjected to insulation displacement connection thereto, and the BACK, TURN (R), STOP, and TAIL conductive paths 30*a*, 30*c*, 30*d*, and 30*e* are passed through.

As shown in FIG. 3, each of the bulb socket connectors 20 (20*a* to 20*f*) is a socket housing which includes bulb conductor portions 22 (see FIGS. 8A and 8B) respectively exposed at the rear end of the bulb 21 as well as contact spaces for contact with the insulation displacement terminals 42 accommodated in the insulation displacement connector 40 (hereafter, this socket connector will be referred to as the socket housing). Namely, as the socket housing 20 with the bulb 21 fitted thereto is engaged with the insulation displacement connector 40, the insulation displacement terminals 42 inside the insulation displacement connector 40 and the bulb conductor portions 22 of the bulb 21 are electrically connected directly.

In the insulation displacement connector 40, the plurality of insulation displacement terminals 42 having insulation displacement blades 42*a* are accommodated from the rear into a terminal accommodating chamber 43 provided in the connector housing 41. The flat cable 30 is subjected to insulation displacement connection to these insulation displacement blades 42*a* by the pressing force of the connector cover 41*a* (see FIG. 4).

As shown in FIGS. 5 to 7, flexible arms 23 for retaining the bulb conductor portions 22 of the bulb 21 are provided on the respective bulb socket connectors 20 (20*a* to 20*f*). Namely, as shown in FIG. 5, each flexible arm 23 retains the bulb conductor portion 22 by means of its retaining pawl 23*a* while undergoing elastic deformation as the bulb 21 is fitted into the respective socket housing 20. Thus the bulb 21 is retained inside the socket housing 20.

The connector housing 41 of the insulation displacement connector 40 is provided with flexible lock arms 44 for locking the flexible arms 23 and a housing lock 45 for retaining the socket housing 20.

Namely, as shown in FIGS. 6 and 7, as the insulation displacement connector 40 and the socket housing 20 are engaged with each other, each flexible lock arm 44 abuts against the rear surface of the flexible arm 23 located away from the retaining pawl 23*a*, and prevents the displacement of the flexible arm 23 in the locked state.

As the insulation displacement connector 40 and the socket housing 20 are engaged with each other, the housing lock 45 retains the socket housing 20, and holds the state of engagement between the insulation displacement connector 40 and the socket housing 20. Accordingly, it is possible to reliably prevent the bulb 21 from coming off when the insulation displacement connector 40 is engaged.

It should be noted that the bulbs used in the rear combination lamp include the double bulb (one having two filaments) 21, such as the one shown in FIG. 8A, and a single bulb (one having a single filament) 21A, such as the one shown in FIG. 8B. The double bulb is used for T/S, while the single bulbs are mainly used for TURN, BACK, R-FOG, TAIL, and the like.

Insulation displacement connectors 40A and 40B illustrated in FIGS. 9 and 10 show variations of the insulation displacement terminals 42 corresponding to the through insulation displacement of the flat cable 30. By selecting insulation displacement terminals 42A, 42B, 42C, and 42D incorporated in the connector housing 41, it is possible to change the combination of the insulation displacement connection and passage through of the insulation displacement connectors 40A and 40B with respect to the conductive paths 30*a* to 30*f* of the flat cable 30.

Accordingly, not only can necessary circuits be selectively subjected to insulation displacement connection, but the insulation displacement terminals can be selected at the time of using the single bulbs and double bulbs. At that juncture, the connector housing 41 can be used in common for both the single bulb and the double bulb, thereby making it possible to effect a cost reduction.

A description will be given of the operation of this embodiment.

In the rear combination lamp 10 in accordance with this embodiment, each insulation displacement connector 40 fitted in a required position on the flat cable 30 in correspondence with each bulb socket connector 20 selectively effects insulation displacement of the required conductive paths 30*a* to 30*f* of the flat cable 30 in correspondence with the function of each bulb socket connector 20. The other unnecessary conductive paths 30*a* to 30*f* are selectively passed through.

As each insulation displacement connector 40 and each socket housing 20*a* to 20*f* with the bulb 21 fitted thereto are engaged, the insulation displacement terminals 42 of the insulation displacement connector 40 and the bulb conductor portions 22 of the bulb 21 are electrically connected directly. At that juncture, the flexible arms 23 of the socket housing 20*a* to 20*f* retaining the bulb conductor portions 22 of the bulb 21 are locked by the flexible lock arms 44 of the insulation displacement connector 40. The state of engagement is held by the housing lock 45 of the insulation displacement connector 40.

As described above, according to the structure for connecting a rear combination lamp in accordance with this embodiment, each insulation displacement connector 40 selectively effects insulation displacement of the required conductive paths 30*a* to 30*f* of the flat cable 30 in correspondence with the function of each bulb socket connector 20. The other unnecessary conductive paths 30*a* to 30*f* are passed through without being subjected to insulation displacement connection.

In addition, as each insulation displacement connector 40 and each socket housing 20*a* to 20*f* with the bulb 21 fitted thereto are engaged, the insulation displacement terminals 42 and the bulb conductor portions 22 of the bulb 21 are electrically connected directly.

The flexible arms 23 for retaining the bulb conductor portions 22 are provided, and the connector housing 41 of the insulation displacement connector 40 is provided with the flexible lock arms 44 for locking the flexible arms 23.

Accordingly, it is possible to effect electric connection reliably and simplify the connector connecting structure and the structure of the bulb socket connector 20. Namely, it is possible to make unnecessary splicers for connecting together bulb sockets as well as joint parts for cables and the like, which are conventionally required. Additionally, the socket housing can be used as the sole component part of the bulb socket connector 20. Consequently, it is possible to reduce the number of component parts and the number of assembling steps and make it possible to effect a substantial reduction in cost.

As described above, according to the structure for connecting a combination lamp in accordance with the invention, each of the insulation displacement connectors selectively effects insulation displacement connection to required conductive paths of the flat cable in correspondence with the function of each of the bulb socket connectors, and unnecessary conductive paths are passed through each of the insulation displacement connectors without being subjected to insulation displacement connection.

Accordingly, it is possible to establish reliable electric connection, reduce the number of component parts and the number of assembling steps by simplifying the structure, and effect a substantial reduction in cost.

In addition, according to the structure for connecting a combination lamp in accordance with the invention, each of the insulation displacement terminals and each of the bulb conductor portions are electrically connected directly as the insulation displacement connector and the bulb socket connector which is a socket housing with the bulb fitted thereto are engaged.

Accordingly, it is possible to establish reliable electric connection, reduce the number of component parts and the number of assembling steps by simplifying the structure, and effect a substantial reduction in cost.

In addition, according to the structure for connecting a combination lamp in accordance with the invention, in the socket housing, each of the insulation displacement terminals and each of the bulb conductor portions are electrically connected directly as the insulation displacement connector and the bulb socket connector which is a socket housing with the bulb fitted thereto are engaged.

In addition, the socket housing is provided with a flexible arm for retaining the bulb conductor portion, and the housing of the insulation displacement connector is provided with a flexible lock arm for locking the flexible arm.

Accordingly, it is possible to establish reliable electric connection, reduce the number of component parts and the number of assembling steps by simplifying the structure, and effect a substantial reduction in cost.

In addition, according to the structure for connecting a combination lamp in accordance with the invention, in the socket housing, each of the insulation displacement terminals and each of the bulb conductor portions are electrically connected directly as the insulation displacement connector and the bulb socket connector which is a socket housing with the bulb fitted thereto are engaged.

In addition, the connector housing of the insulation displacement connector is provided with a housing lock for retaining the socket housing.

Accordingly, it is possible to establish reliable electric connection and reduce the number of component parts and the number of assembling steps by simplifying the structure.

Furthermore, the common use of the housings and the selective terminals based on their structures permit make it possible to effect a substantial cost reduction.

What is claimed is:

1. A structure for connecting a combination lamp to a wire harness comprising:

a plurality of bulb socket connectors fitted to the combination lamp;

a plurality of insulation displacement connectors mounted on the plurality of bulb socket connectors, respectively; and a flat cable including conductive paths, mounted on the plurality of insulation displacement connectors, one end thereof being connected to an electric junction box, wherein each of the plurality of insulation displacement connectors selectively effects insulation displacement connection to required one of the conductive paths according to a function of each of the plurality of bulb socket connectors, and unnecessary one of the conductive path is passed through the corresponding insulation displacement connectors without being subjected to insulation displacement connection.

2. The structure according to claim 1, wherein the combination lamp is provided on either side of a rear end of a vehicle body.

3. A connecting structure for a combination lamp comprising:

a bulb socket housing, on which a bulb is mounted, fitted to a lamp body of the combination lamp;

a flat cable, one end thereof being connected to an electric junction box;

an insulation displacement connector including insulation displacement terminals subjected to insulation displacement connection at a predetermined position on the flat cable; and contact spaces for contact between bulb conductor portions exposed at a rear end of the bulb and the insulation displacement terminals, wherein each of the insulation displacement terminals and each of the bulb conductor portions are electrically connected directly as the insulation displacement connector is engaged with the bulb socket housing with the bulb fitted thereto, and wherein the bulb socket housing is provided with a flexible arm for retaining the bulb conductor portion, and a housing of the insulation displacement connector is provided with a flexible lock arm for locking the flexible arm.

4. The structure according to claim 3, wherein the combination lamp is provided on either side of a rear end of a vehicle body.

* * * * *